US011788440B2

(12) United States Patent
Wolking et al.

(10) Patent No.: US 11,788,440 B2
(45) Date of Patent: Oct. 17, 2023

(54) COVER BODY FOR VALVE ROTATING DEVICE, CORRESPONDING VALVE ROTATING DEVICE AND METHOD FOR PRODUCING THE COVER BODY

(71) Applicant: FEDERAL-MOGUL VALVETRAIN GMBH, Barsinghausen (DE)

(72) Inventors: Antonius Wolking, Barsinghausen (DE); Luthfi Arief, Hannover (DE); Florian Ringeling, Hannover (DE)

(73) Assignee: Federal-Mogul Valvetrain GmbH, Barsinghausen (DE)

( * ) Notice: Subject to any disclaimer, the term of this patent is extended or adjusted under 35 U.S.C. 154(b) by 0 days.

(21) Appl. No.: 17/232,637

(22) Filed: Apr. 16, 2021

(65) Prior Publication Data

US 2021/0332724 A1 Oct. 28, 2021

(30) Foreign Application Priority Data

Apr. 23, 2020 (DE) ..... 10 2020 111 090.1

(51) Int. Cl.

| | |
|---|---|
| ***F01L 1/32*** | (2006.01) |
| *F01L 1/46* | (2006.01) |
| *F01L 3/10* | (2006.01) |

(52) U.S. Cl.

CPC ..... *F01L 1/32* (2013.01); *F01L 1/462* (2013.01); *F01L 3/10* (2013.01); *F01L 2303/00* (2020.05)

(58) Field of Classification Search

CPC ..... F01L 1/32; F01L 1/462; F01L 3/10; F01L 2303/00

(Continued)

(56) References Cited

U.S. PATENT DOCUMENTS 2,624,323 A * 1/1953 Thorne ..... F01L 1/32 123/90.3
2,686,508 A * 8/1954 Ralston ..... F01L 1/32 123/90.3

(Continued)

FOREIGN PATENT DOCUMENTS

DE 102017126541 B3 * 11/2018 ..... F01L 3/10
DE 102017126541 B3 11/2018
GB 2040399 A * 8/1980 ..... F16K 29/00

*Primary Examiner* — Jorge L Leon, Jr.
(74) *Attorney, Agent, or Firm* — Robert L. Stearns; Dickinson Wright PLLC

(57) ABSTRACT

A cover body (2) for a valve rotating device includes a ring-shaped upper part (4) and a ring-shaped lower part (6). The upper part (4) and the lower part (6) are axially spaced apart and are adapted to accommodate an axial spring element (24) therebetween. The upper part (4) and the lower part (6) are connected to one another by at least one connecting piece arranged at the location opposite an insertion position of the axial spring element (24).

A valve rotating device (12) having such a cover body is also provided. A ring-shaped base body (22) has a plurality of pockets (16) oriented in a circumferential direction, in each of which a ball (14) and a tangential spring (32) are arranged. The pockets (16) have a variable depth in the circumferential direction such that inclined raceways (26) for the balls (14) arranged therein are formed. The tangential springs (32) push the balls (14) toward an end of the respective pocket (16). The axial spring element (24) is ring-shaped and a first end of the axial spring element (24) is supported on an ring-shaped stop surface (18) of the base body (22) and a second end of the axial spring element (24) is supported on a surface of the upper part (4) of the cover. A surface of the lower part (6) facing away from the axial spring element (24) rests against the balls (14), and wherein the balls (14) and the axial spring element (24) are arranged overlapping in the axial direction.

(Continued)

A method for producing a cover both (2) for a valve rotating device is also provided.

12 Claims, 3 Drawing Sheets

(58) Field of Classification Search
USPC ..... 123/90.28, 90.3
See application file for complete search history.

(56) References Cited

U.S. PATENT DOCUMENTS

| | | | | | |
|---|---|---|---|---|---|
| 3,710,768 | A * | 1/1973 | May | F01L 1/32 | 123/90.3 |
| 3,890,943 | A * | 6/1975 | Schonlau | F01L 1/32 | 123/90.3 |
| 4,075,987 | A * | 2/1978 | Tauschek | F01L 1/32 | 123/90.28 |
| 4,141,325 | A * | 2/1979 | Shalaty | F01L 1/32 | 123/90.3 |
| 4,154,424 | A * | 5/1979 | Cherrie | F01L 1/32 | 123/90.3 |
| 4,538,558 | A * | 9/1985 | Updike | F01L 3/10 | 123/90.3 |
| 2003/0037742 | A1* | 2/2003 | Engesser | F01L 1/32 | 123/90.31 |
| 2020/0347755 | A1* | 11/2020 | Wolking | F01L 1/32 | |

* cited by examiner

COVER BODY FOR VALVE ROTATING DEVICE, CORRESPONDING VALVE ROTATING DEVICE AND METHOD FOR PRODUCING THE COVER BODY

CROSS-REFERENCE TO RELATED APPLICATION

This U.S. Utility Patent application claims priority to Germany Patent Application No. 10 2020 111 090.1, filed Apr. 23, 2020, the entire contents of which are incorporated herein by reference.

BACKGROUND OF THE INVENTION

1. Technical Field

The present invention relates to a cover body for a valve rotating device for internal combustion engines, a corresponding valve rotating device, and a method for producing the cover body.

2. Related Art

To prevent uneven load on the valves of an internal combustion engine in the circumferential direction, a constant rotation of the valves is necessary during operation. Due to the rotation, one-sided wear and deposits on the valve seat are avoided. In addition, an even temperature distribution in the circumferential direction is achieved. If the "natural rotation" of the valves is too slight, forced rotation devices, so-called valve rotating devices, are used.

Valve rotating devices generate valve rotation in that balls that are arranged in pockets in a base body and rest against a disk spring are forced to roll on inclined raceways formed in the pockets and thus rotate the base body and the disk spring relative to one another about the valve axis. A cover which at the same time supports the valve spring is connected to the disk spring by frictional locking. The rotation can take place either during the valve opening stroke or during the valve closing stroke. Top-mounted designs, i.e., the valve rotating device is located on the side of the valve spring facing away from the combustion chamber, as well as bottom-mounted designs, i.e., the valve rotating device is located on the side of the valve spring facing the combustion chamber, are possible. In the top-mounted design, the base body has a conical opening into which conical sections are inserted which hold the valve on the stem end. In the bottom-mounted design, the base body rests on the cylinder head, and the rotation is transmitted to the valve via the valve spring.

Due to the point contact of the balls with the disk spring, high rolling pressures occur which result in a high load on the disk spring. The high rolling load results in wear on the disk spring, in particular pitting (i.e., pitting corrosion or point corrosion).

From DE 10 2017 126 541 B3, a valve rotating device with a cover body is already known, which has a housing intended to accommodate an axial spring element. The disadvantage of this is that the housing-shaped cover is complicated and is to be produced in multiple steps with the material input being high and causing correspondingly high costs.

It is an object of the present invention to provide an improved valve rotating device with a cover body which can be produced in a simple and material-saving manner.

SUMMARY OF THE INVENTION

According to a first aspect, the invention relates to a cover body for a valve rotating device comprising a ring-shaped upper part and a ring-shaped lower part, wherein the upper part and the lower part are axially spaced apart and are adapted to accommodate an axial spring element therebetween, wherein the upper part and the lower part are connected to each other by at least one connecting piece, wherein the at least one connecting piece is arranged at the location opposite an insertion position of the axial spring element.

The advantage of the cover body according to the invention is that it can be produced in few work steps in a material-saving manner, thereby reducing the production costs.

It is preferred that the at least one connecting piece is arranged radially outside the inserted axial spring element. The advantage of the arrangement is that the inserted axial spring element is not hindered in its function.

It is preferred that the at least one connecting piece is arranged laterally outside the edge on the lower part. The arrangement laterally outside the edge on the lower part saves material.

It is preferred that the at least one connecting piece is arranged laterally outside the edge on the upper part. The arrangement laterally outside the edge on the upper part saves material.

It is preferred that the at least one connecting piece is arranged within a space spanned by the cross-sections of the upper part and the lower part. An advantage of the arrangement of the at least one connecting piece within this spanned space is a more compact design.

It is preferred that the at least one connecting piece detachably connects the upper part and the lower part. A detachable connection of the upper part and the lower part ensures easy replacement of the axial spring element by disassembling the cover body.

It is preferred that the at least one connecting piece has at least 2 connecting pieces spaced apart from each other. This has the advantage that the load is distributed more evenly.

It is preferred that the at least one connecting piece has at least 3 connecting pieces spaced apart from each other. This has the advantage that the load is even more evenly distributed.

It is preferred that the upper part and the lower part are formed integrally or in one piece with the at least one connecting piece. The advantage of an integral or one-piece design is that few work steps are necessary during production. For example, the cover body can be produced from a metal sheet by punching and bending.

It is preferred that the upper part has at least 2 axial projections for guiding at least one valve spring. This provides a simple adjustment for variation possibilities of the valve spring guide.

It is preferred that the upper part has at least 1 recess for guiding at least one valve spring. The advantage of a recess for guiding at least one valve spring is further material savings.

It is preferred that the upper part and the lower part are flat disk-shaped bodies made of metal. The advantage of flat disk-shaped bodies is that they can be punched without any problems.

According to another aspect of the invention, a valve rotating device is provided which is equipped with the cover body according to the invention. The valve rotating device comprises a ring-shaped base body which has a plurality of pockets oriented in a circumferential direction, in each of which a ball and a tangential spring are arranged, wherein the pockets have a variable depth in the circumferential direction such that inclined raceways are formed for the balls arranged therein, wherein the tangential springs push the balls towards an end of the respective pocket, a cover body according to any one of the preceding claims, wherein the axial spring element is ring-shaped and a first end of the axial spring element is supported on a ring-shaped stop surface of the base body and a second end of the axial spring element is supported on a surface of the upper part, wherein a surface of the lower part facing away from the axial spring element rests against the balls, and wherein the balls and the axial spring element are arranged overlapping in the radial direction.

The advantage of the valve rotating device according to the invention is that it can be produced in a simple and material-saving manner, thereby reducing production costs.

According to another aspect of the invention, a method of producing a cover body for a valve rotating device is provided, comprising punching a metal sheet which, after punching, has two ring-shaped parts connected to each other by at least one connecting piece, wherein the punched metal sheet is transformed into a cover body by bending.

The method according to the invention has the advantage that few work steps have to be carried out for producing a cover body.

It is preferred that the punched metal sheet has at least 2 connecting pieces that are spaced apart from each other. At least 2 connecting pieces that are spaced apart from each other have the advantage that the load is distributed more evenly.

It is preferred that the punched metal sheet has at least 3 connecting pieces that are spaced apart from each other. At least 3 connecting pieces that are spaced apart from each other have the advantage that the load is distributed even more evenly.

It is preferred that the punched metal sheet has at least 2 projections for guiding at least one valve spring which, by bending, are brought into a position aligned at substantially 90° relative to the upper part. This provides a simple adjustment for variation possibilities of the valve spring guide.

It is preferred that the punched metal sheet has at least 1 recess for guiding at least one valve spring. The advantage of a recess for guiding at least one valve spring is further material savings.

BRIEF DESCRIPTION OF THE DRAWINGS

In the following, exemplary embodiments of the invention are described in more detail with reference to the figures, wherein.

DETAILED DESCRIPTION

Figure 1:
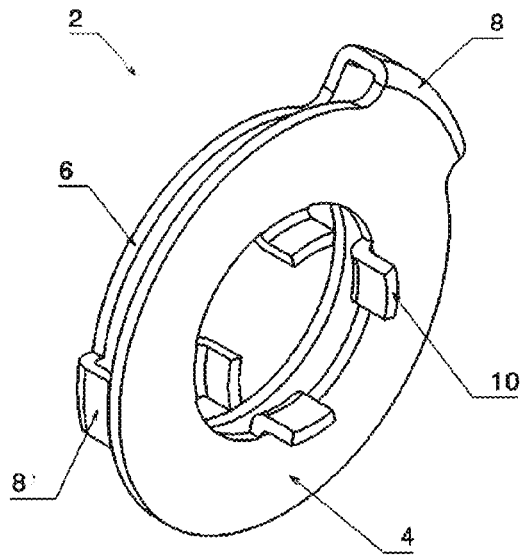
FIG. 1 shows a cover body according to an embodiment of the invention.

FIG. 1 shows a cover body 2 according to one embodiment of the invention. The cover body 2 comprises a ring-shaped disk-shaped upper part 4, a ring-shaped disk-shaped lower part 6, and connecting pieces 8 and 8' and 4 projections 10.

The upper part 4 and the lower part 6 are axially spaced apart and connected to each other by the bead-like connecting piece 8. The connecting piece 8' and a further connecting piece 8' (not visible) have an L-shaped configuration, are arranged laterally on the lower part 6 and are aligned in the direction of the upper part 4 by bending and connected thereto.

The connecting pieces 8 and 8' are arranged such that an axial spring element can be passed between them, the connecting pieces 8 and 8' being welded, screwed or riveted to the mating part if or as required.

Projections 10 are shown on the upper part 4, which are punched out, cut or sawed. They are aligned axially outward at 90° by bending and guide the valve spring. Alternatively, a recess (not shown) on the upper part 4 can be the guide of the valve spring.

Figure 2:
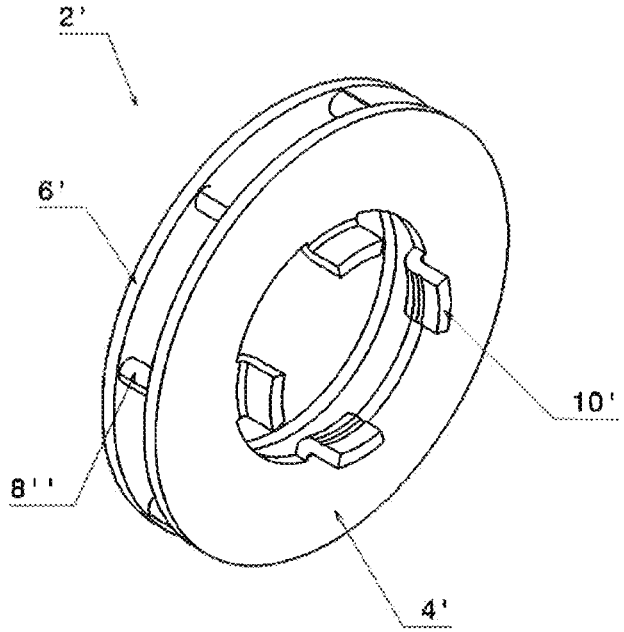
FIG. 2 shows a further cover body according to another embodiment.

FIG. 2 shows a further cover body 2' according to another embodiment in which the upper part 4' is connected to the lower part 6' by a plurality of connecting pieces 8" that are spaced apart from each other. In this case, the connecting pieces 8" are arranged on only one half of the ring in order to ensure that an axial spring element 24 can be accommodated on a side opposite the connecting pieces 8", extend in an edge region of the space between the upper part 4' and the lower part 6' and are welded, screwed or riveted to the mating part if or as required.

Projections 10' are shown on the upper part 4' which are punched out, cut or sawed. They are axially aligned by bending and guide the valve spring. Alternatively, a recess (not shown) on the upper part 4' can be the guide of the valve spring.

Figure 3:
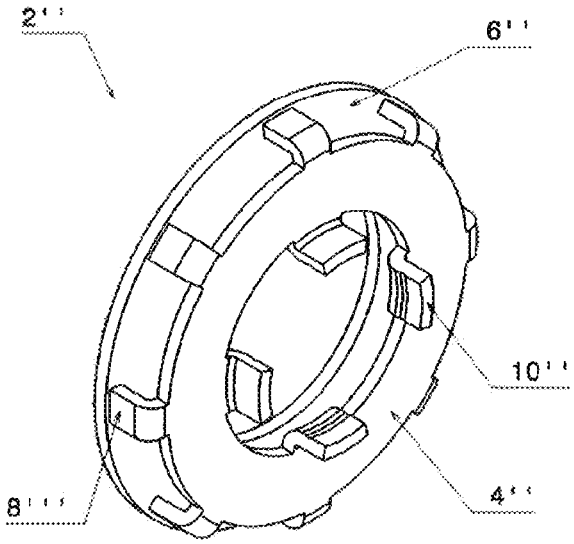
FIG. 3 shows yet another cover body according to yet another embodiment.

FIG. 3 shows yet another cover body 2" according to yet another embodiment in which the connection between upper part 4" and lower part 6" is formed in the form of a plurality of connecting pieces 8'" which are arranged laterally on the upper part 4" and are aligned in the direction of the lower part 6" by bending. The connecting pieces 8'" are welded, screwed or riveted to the mating part if or as required.

Projections 10" are shown on the upper part 4" which are punched out, cut or sawed. They are axially aligned by bending and guide the valve spring. Alternatively, a recess (not shown) on the upper part 4' can be the guide of the valve spring.

Figure 4:
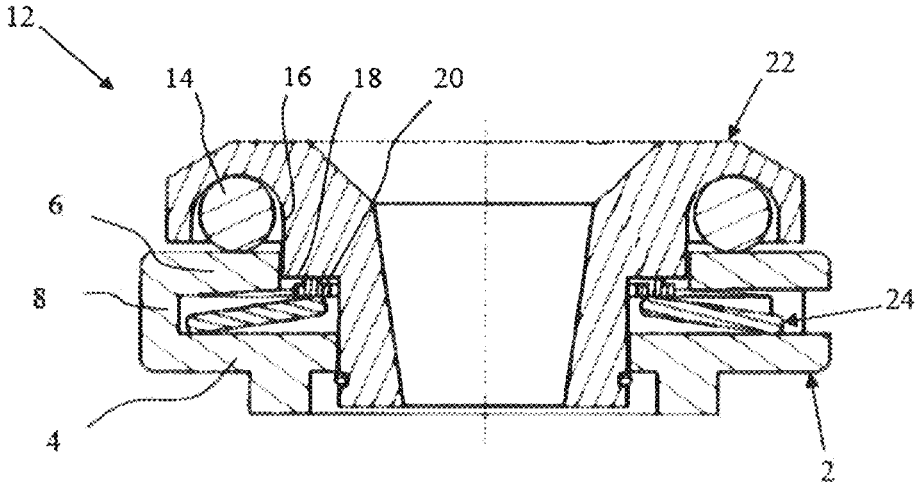
FIG. 4 shows an axial section of a valve rotating device according to the invention.

FIG. 4 shows a valve rotating device according to the invention in an axial section, i.e., an axis of the valve rotating device lies in the sectional plane. The valve rotating device comprises a ring-shaped base body 22, a ring-shaped cover body 2 and a ring-shaped axial spring element 24. The base body 22 and the cover body 2 are rotatable relative to each other about the axis of the valve rotating device (thus in the circumferential direction) and displaceable relative to each other in the axial direction. A top-mounted design is shown. Accordingly, the base body 22 is provided with a conical opening into which conical pieces suitable for holding a valve can be inserted. Likewise, a bottom-mounted design is possible. In this case, a conical opening is not necessary but merely an opening through which the stem of a valve can pass.

Figure 5:
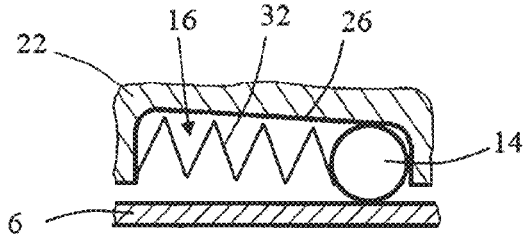
FIG. 5 shows a section in the circumferential direction of a pocket.

A plurality of pockets 16 (or recesses) are formed in the base body 22 in the circumferential direction, which pockets are oriented in the circumferential direction and extend in each case over a certain angular range in the circumferential direction (perpendicular to the drawing plane). A depth of the pockets 16 (thus, the extent of the pockets in the axial direction) is variable in the circumferential direction such that an inclined raceway 26 is formed in each of the pockets 16, cf. FIG. 5. A ball 14 and a tangential spring 32, cf. FIG. 5, are arranged in each of the pockets 16, the ball being able to roll on the inclined raceway 26. A diameter of the balls 14 should be greater than a least depth of the pockets 16. Preferably, all balls 14 have the same diameter and all pockets 16 have the same dimensions. The tangential springs 32 push the balls 14 in the circumferential direction against a respective end of the pockets 16, namely against the end where the corresponding pocket 16 has its least depth.

Furthermore, the base body 22 has a stop surface 18 on which a first end of the axial spring element 24 is supported, wherein the stop surface 18 is preferably located radially (thus, in a direction perpendicular to the axis) further inward than the pockets 16. A bearing 20 is arranged on the stop surface 18, which allows low-friction rotation of the base body 22 and the axial spring element 24 relative to each other about the axis.

In the axial direction, the axial spring element 24 is arranged between the upper part 4 and the lower part 6, wherein a second end of the axial spring element 24 is supported on a surface of the upper part 4. In the radial direction, the axial spring element 24 is arranged further inward than the connecting piece 8. The axial spring element 24 causes a spring force in the axial direction, which pushes the base body 22 and the cover body 2 apart, if necessary, since the first end of the axial spring element 24 is supported on the stop surface 18 of the base body 22. The axial spring element 24 and the balls 14 are arranged to overlap in the axial direction. In the axial direction, the axial spring element 24 and the balls 14 are arranged side by side, with the lower part 6 being located between the axial spring element 24 and the balls 14. Overall, the preferred sequence in the axial direction is: upper part 4, axial spring element 24, lower part 6, balls 14, or, in other words, these four parts overlap in the axial direction. A disk spring is preferably used as the axial spring element 24.

A surface of the lower part 6 facing away from the axial spring element 24 rests against the balls 14 which are arranged in the pockets 16 of the base body 22. If the base body 22 and the cover body 2 are pressed together against the force of the axial spring element 24, e.g. during the opening stroke of the valve, an axial force is exerted on the balls 14 which then roll on the inclined raceway 26 in the pockets 16 on the one hand and on the surface of the lower part 6 facing away from the axial spring element on the other. As a result, the base body 22 and cover body 2 are rotated relative to each other about the axis. When the valve rotating device is unloaded, e.g. during the closing stroke of the valve, the axial spring element 24 pushes the base body 22 and the cover body 2 apart again, whereby the force acting on the balls 14 becomes smaller and thus no rolling of the balls takes place when they are reset by the tangential springs 32.

In contrast to known valve rotating devices, the rolling of the balls 14 does not take place on the disk spring 24, but on the lower part 6. As a result, high rolling pressure on the disk spring 24 and the accompanying wear is avoided. The lower part 6, in turn, can be designed in a simpler manner according to the rolling loads that occur, since it does not have to assume a spring function at the same time. Likewise, the selection of the axial spring element 24, in particular a disk spring 24, is not restricted by the rolling loads, thus, a freer design of the axial spring element 24 is made possible. This also enables a compact, space-saving design of the valve rotating device. Since the disk spring 24 is fully inserted into the cover body 2, the complete stroke movement of the disk spring 24 is converted into a rotary movement via the inclination of the pockets 16. Compared to previous designs, the rotary movement per stroke can be increased by a factor of approximately 1.5 to 2. With the rotation remaining unchanged, a stiffer disk spring 24 with increased service life can be used as an alternative.

The upper surface of the lower part 6 facing away from the axial spring element 24 can have a ball raceway, thereby reducing the rolling pressure on the lower part 6, for example.

The upper surface of the upper part 4 facing away from the axial spring element 24 is preferably configured to serve as a support surface for a valve spring.

FIG. 5 shows a partial sectional view in the circumferential direction, showing a pocket 16 with an inclined raceway 26. A ball 14 and a tangential spring 32 are arranged in the pocket 16, which tangential spring pushes the ball 14 against the end of the pocket 16 where the pocket 16 has its least depth. Also shown is a section of the lower part 6 resting against the ball 14. Under axial load, the base body 22, cf. FIG. 4, and the lower part 6 are moved towards each other so that the ball 14 rolls on both the inclined raceway 26 and the surface of the lower part 6, thus rotating the base body 22 relative to the cover body 2 about the axis.

Figure 6:
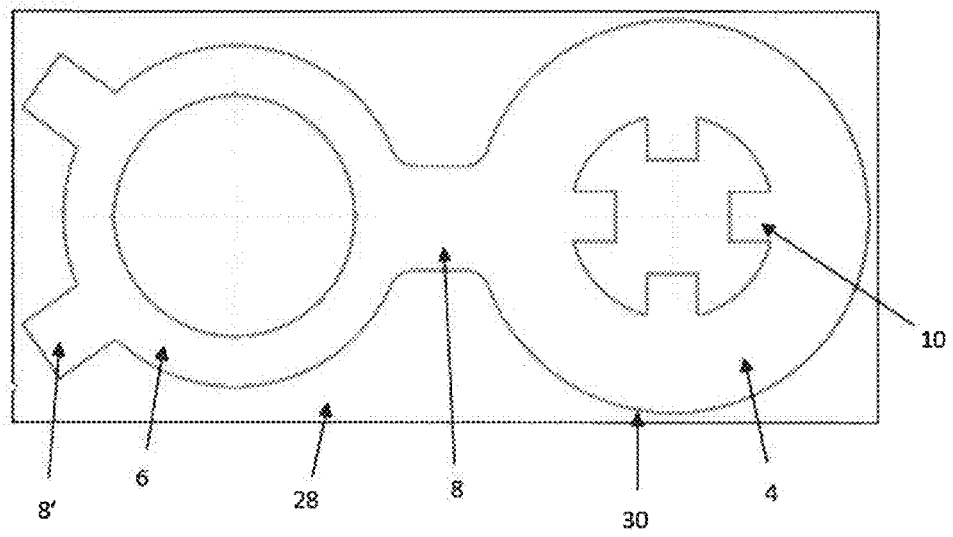
FIG. 6 shows a metal sheet with a punched contour.

FIG. 6 shows a metal sheet 28 with a punched contour 30. The punched contour 30 has two ring-shaped parts, namely the upper part 4 on the one hand and the lower part 6 on the other, which are connected by the connecting piece 8 and the upper part 4 having a larger outer diameter than the lower part 6.

Furthermore, the upper part 4 has projections 10 which are directed inwardly and bent in the axial direction for guiding a valve spring and, moreover, the lower part 6 has connecting pieces 8' which are directed outwardly and are provided bent in the axial direction for connection to the upper part 4.

Obviously, many modifications and variations of the present invention are possible in light of the above teachings. It is, therefore, to be understood that the invention may be practiced otherwise than as specifically described while still being within the scope of the invention.

What is claimed is:

1. A cover body for a valve rotating device, said cover body comprising:

a single sheet of sheet metal formed into a ring-shaped upper part, a ring-shaped lower part, and at least one integral connecting piece extending between and formed as one piece with the upper and lower parts, wherein the at least one integral connecting piece includes an outer width dimension which is less than an outer diameter of each of the upper and lower parts, wherein the single sheet of sheet metal is bent at the at least one integral connecting piece such that the upper part is coaxially aligned above the lower part so as to define an axial space configured to accommodate an axial spring element, and wherein the at least one integral connecting piece is disposed laterally outside of an outer perimeter edge of the lower part after the bending of the single sheet of sheet metal.

2. The cover body according to claim 1, wherein the at least one integral connecting piece is arranged radially outside the axial spring element when the axial spring element is inserted into the axial space.

3. The cover body according to claim 1, wherein the at least one integral connecting piece is disposed laterally outside of an outer perimeter edge of the upper part after the bending of the single sheet of sheet metal.

4. The cover body according to claim 1, wherein the at least one integral connecting piece includes at least three connecting pieces that are spaced apart from each other, and wherein one connecting piece of the at least three connecting pieces is disposed laterally outside of the outer perimeter edge of the lower part.

5. The cover body according to claim 1, wherein the upper part includes at least two axial projections configured to guide at least one valve spring.

6. The cover body according to claim 1, wherein the upper part includes at least one recess configured to guide at least one valve spring.

7. A valve rotating device for internal combustion engine, comprising:

a ring-shaped base body including a plurality of pockets formed as inclined raceways and arrayed circumferentially, each pocket including a tangential spring biasing a ball towards a first end of the pocket; and a cover body comprising a single sheet of sheet metal formed into a ring-shaped upper part, a ring-shaped lower part, and at least one integral connecting piece bridging the upper and lower parts, wherein the upper part is coaxially aligned and spaced from the lower part so as to define an axial space configured to accommodate a ring-shaped axial spring element, wherein a first axial end of the axial spring element is supported on a ring-shaped stop surface of the base body, and a second axial end of the axial spring element is supported on an axial end surface of the upper part, wherein an axial end surface of the lower part facing away from the axial spring element rests against the balls such that the balls axially overlap the axial spring element, and wherein the at least one integral connecting piece is disposed laterally outside of respective outer perimeter edges of the upper and lower parts.

8. A method for producing a cover body for a valve rotating device, the method comprising:

punching a single metal sheet so as to produce a first ring-shaped portion and a second ring-shaped portion connected to each other via at least one integral connecting portion configured to bridge respective outer perimeter edges of the first and second ring-shaped portions; and bending the at least one integral connecting portion so as to fold the first ring-shaped portion over the second ring-shaped portion such that the first and second ring-shaped portions are coaxially aligned and spaced from each other thereby defining an axial space configured to accommodate an axial spring element, wherein, after the bending, the at least one integral connection portion is disposed laterally outside of the respective outer perimeter edges of the first and second ring-shaped portions.

9. The method according to claim 8, wherein the at least one integral connecting portion includes at least two connecting portions that are spaced apart from each other, and wherein one of the at least two connecting portions is disposed laterally outside of the respective outer perimeter edges of the first and second ring-shaped portions.

10. The method according to claim 8, wherein the at least one integral connecting portion includes at least three connecting portions that are spaced apart from each other, and with wherein one of the at least three connecting portions is disposed laterally outside of the respective outer perimeter edges of the first and second ring-shaped portions.

11. The method according to claim 8, wherein the punching of the metal sheet further produces at least two projections extending from the first ring-shaped portion, and wherein the bending further includes bending the at least two projections so as to extend perpendicularly from an axial end surface of the first ring-shaped portion, the at least two projections configured to guide at least one valve spring.

12. The method according to claim 8, wherein the punching of the metal sheet further produces at least one recess on the first ring-shaped portion, the at least one recess configured to guide at least one valve spring.

* * * * *